US005752313A

United States Patent [19]

Gaffaney et al.

[11] Patent Number: 5,752,313

[45] Date of Patent: May 19, 1998

[54] TUBE EXPANDER WITH FORCE SENSOR

[75] Inventors: Daniel P. Gaffaney, Chittenango; Steven J. Spencer, Liverpool, both of N.Y.

[73] Assignee: Carrier Corporation, Syracuse, N.Y.

[21] Appl. No.: 169,258

[22] Filed: Dec. 20, 1993

[51] Int. Cl.[6] ..... B23P 15/26; B21D 39/08

[52] U.S. Cl. ..... 29/727; 29/33 T; 29/523; 29/714; 29/890.044; 72/370

[58] Field of Search ..... 29/33 T, 407, 29/522.1, 523, 524, 726, 727, 890.044, 890.047, 890.053, 714; 72/58, 62, 462, 370

[56] References Cited

U.S. PATENT DOCUMENTS

| | | | |
|---|---|---|---|
| 3,718,017 | 2/1973 | Blackburn | 29/726 X |
| 4,228,573 | 10/1980 | Barnard | 29/890.47 X |
| 4,369,662 | 1/1983 | Rieben et al. | 29/522.1 X |
| 4,513,497 | 4/1985 | Finch | 72/62 X |
| 4,649,493 | 3/1987 | Castner et al. | 72/58 X |
| 5,033,190 | 7/1991 | Gray | 29/407 X |
| 5,040,405 | 8/1991 | Honma et al. | 29/890.044 X |

*Primary Examiner*—Peter Vo

[57] ABSTRACT

An apparatus for expanding the tubes in a heat exchanger of the plate fin and tube type. The expander is of the type that expands the tubes by driving a "bullet" through the tube with the bullet being attached to and driven by an expander or bullet rod. The apparatus has a sensor positioned so as to be able to measure the compressive force on the expander rod. The output of the sensor is proportional to the force exerted on the rod and can be used to provide an alarm or safety shutdown of the apparatus upon the sensing of excessive force on the expander rod. The sensor output can also be used for quality and process control.

7 Claims, 2 Drawing Sheets

TUBE EXPANDER WITH FORCE SENSOR

BACKGROUND OF THE INVENTION

This invention relates generally to apparatus for manufacturing heat exchangers. More particularly, the invention relates to an apparatus, known as a tube expander, for radially expanding the tubes in a plate fin and tube type heat exchanger.

Plate fin and tube type heat exchangers are commonly used in a variety of applications, particularly in air conditioning and refrigeration equipment as well as in engine cooling systems. In such a heat exchanger, a first fluid, typically a refrigerant or an engine coolant, flows through tubes and a second fluid, typically air, flows around the exterior of the tubes. Heat is exchanged between the two fluids through the walls of the tubes. The rate of heat transfer, and therefore the heat transfer performance of the heat exchanger, can be increased by increasing the area of the external surface of the tubes that is exposed to the second fluid. This is typically done by attaching thin metal plates, or plate fins, to the exterior of the tubes. To be effective for transferring heat and also for mechanical reasons, the plate fins must be in firm physical contact with the exterior of the tubes.

FIG. 1 provides further background for the invention. The figure depicts plate fin and tube heat exchanger 10 at an intermediate stage of manufacture. Heat exchanger 10 comprises hairpin tubes 11, tubesheets 12, plate fins 13 and return bends 15. A typical manufacturing process for making heat exchanger 10 includes the steps of bending straight lengths of tubing into hairpin tubes 11, then inserting hairpin tubes 11 through holes in tubesheets 12 and stacks of plate fins 13. In order to allow the passage of the tubes through the tubesheets and plate fins, the holes must be made with a diameter that is slightly larger than the outer diameter of the tubes. After the tubes are inserted into the tubesheets and plate fin stack, the tubes are expanded radially so that the external surface of the tubes firmly contact the fins. The ends of hairpin tubes 11 are expanded to a greater degree than the rest of the tubes in order to form bellmouths 14. Return bends 15 are then inserted into bellmouths 14 to complete a closed flow path for a first fluid to flow through the tubes of heat exchanger 10. The specific configuration of a given heat exchanger may vary. For example, the flow path of the fluid through the tubes may not be a simple series path but the fluid may flow through the heat exchanger in two or more parallel paths. This is accomplished by providing headers instead of return bends. The heat exchanger may also be of the single pass type, with straight rather than hairpin tubes being used so that fluid flows through the heat exchanger from one side to the other. As it applies to the present invention, however, the process of lacing tubes through plate fins having slightly oversize holes, then expanding the tubes to firmly contact the plate fins is common to the manufacture of most types of plate fin and tube heat exchangers.

Although there are a number of means for expanding tubes during the manufacture of a plate fin and tube heat exchanger, the most common way is mechanical, in which an expansion "bullet" is driven through the tube. The bullet is slightly greater in external diameter than the internal diameter of the tube and sized to result in the desired increase in the external diameter of the tube. The bullet is attached to a rod through which the driving force is applied. As the bullet is driven through a tube, the rod is subjected to a compressive force.

Increasingly, the industry is using tubes of smaller diameters in plate fin and tube heat exchangers. In order to pass through these smaller tubes, the bullet rod must be correspondingly smaller in diameter. A smaller rod is, in general, not as strong as a larger rod. It may be necessary to expand tubes in heat exchangers that are as much as three meters or more in length. A very long rod with a small diameter is subject to buckling under excessive compressive forces.

The typical manufacturing process of expanding tubes in a heat exchanger has, until recently, been largely manually controlled, with a human operator aligning the expander with the tube or tubes to be expanded in a given expander stroke, then actuating the expander. Automated expanders are becoming more commonplace. In such a machine, the heat exchanger is positioned using some type of automatic control, then bullets are driven into the tubes with little or no operator action. Such machines can expand heat exchangers very rapidly and accurately. However, the possibility of misalignment remains, particularly if constant operator oversight is lacking. If the bullets are not precisely aligned with the tubes to be expanded, the bullets may strike the tubesheet, for example, when the expansion stroke commences. If the stroke continues, the bullets, the bullet rods or other parts of the machine, as well as the heat exchanger, may be damaged.

If the force required to drive a bullet through a tube deviates from the norm, that condition is an indication that the tube is in some way different from a standard tube. The tube may, for example, be defective or damaged. Sensing, displaying and recording the compressive stress on the expander rod, therefore, can provide information useful to process and quality control activities.

What is needed, therefore, is a tube expander, for use in manufacturing plate fin and tube heat exchangers, that has the capability to measure and record the compressive forces on its expander or bullet rods for the purposes of protecting the heat exchangers being made and the machine itself from excessive forces and damage as well as for gathering data for process control.

SUMMARY OF THE INVENTION

The present invention is a tube expander having a force sensor positioned so as to be able to sense the compressive force exerted on its expander or bullet rods. The sensor produces an output that is proportional to the sensed force. This output may, if necessary or desirable, be directed to a signal processor, where the output may be used for real time monitoring of the expansion process by a human operator, stored in data files for later analysis as well as to produce an alarm or a shutdown of the machine if a dangerous overload occurs.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Figure 2:
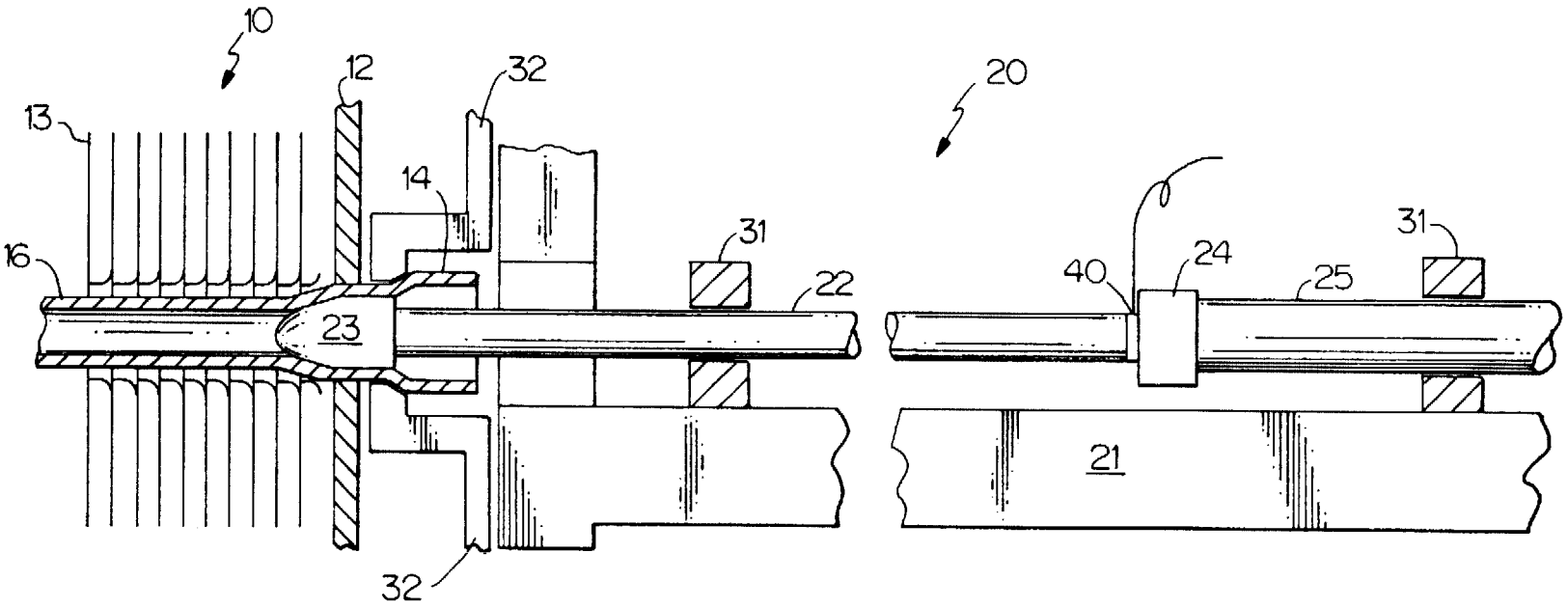
FIG. 2 is a side elevation view, partially sectioned, of the expander of the present invention.

FIG. 2 depicts a tube expander embodying the present invention. Expander 20 is of the tension type. By this is meant that the tube to be expanded is in tension during the expansion operation. Heat exchanger 10 is positioned relative to expander 20 so that the longitudinal axis of hairpin tube 11 is aligned with the longitudinal axis of expander bullet 23 and expander rod 22. Gripper jaws 32 hold tube 11 in this aligned position during expansion. Bullet 23 is attached to one end of rod 22 with the attachment means, in some applications, allowing for rotation of the bullet about the axis of the rod. The other end of rod 22 is attached to yoke 24 either directly or through force sensor 40. Other expander rods (not shown) may also be attached to yoke 24 so that all attached rods operate together. Operating shaft 25 moves yoke 24 laterally in either direction. Shaft 25 in turn is moved by a motive force (not shown) such as a hydraulic cylinder and piston or a motor and a system of gears, cables and blocks or the like. Bearing blocks 31 support shaft 25 and expander rod 22.

Figure 1:
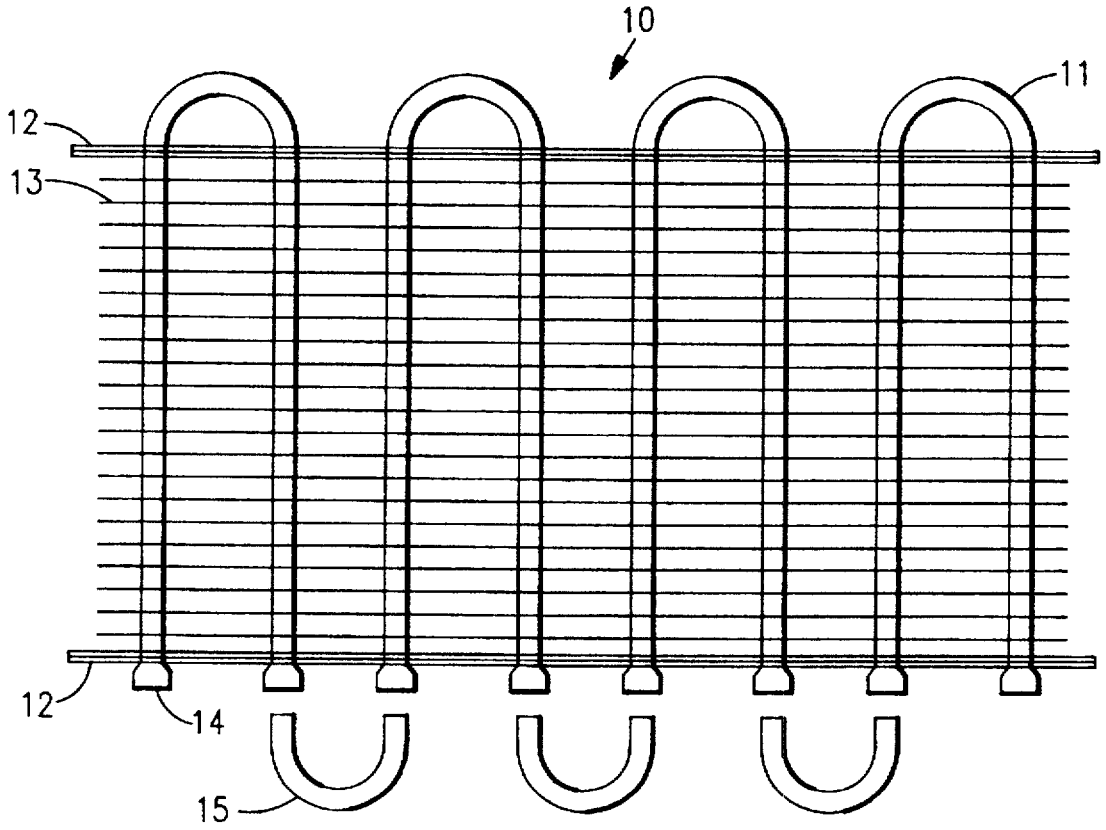
FIG. 1 is a schematic diagram of a typical plate fin and tube heat exchanger, in an intermediate stage of manufacture, of the type upon which the expander of the present invention would be used.
Figure 3:
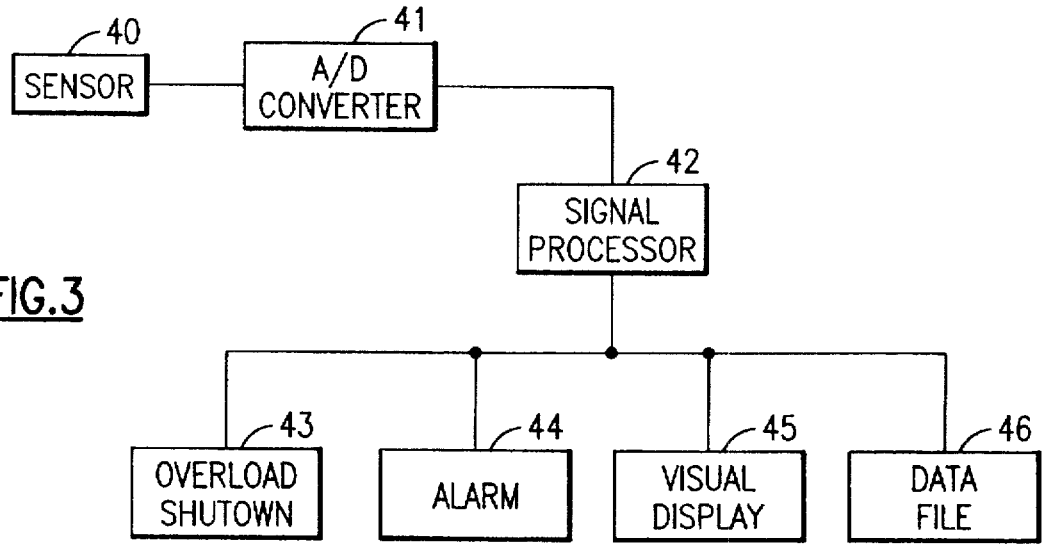
FIG. 3 is a block diagram showing certain of the components of the present invention and their relationships.

In a tube expansion operation, bullet 23, through rod 22, yoke 24 and shaft 25 is first fully retracted (moved to the right in FIG. 3). Tube 11 is then positioned with respect to bullet 23. Gripper jaws 32 engage the tube behind bellmouth 14 to hold the tube in place. Then bullet 23 is driven into tube 11, expanding the wall of the tube, increasing the tube's diameter and thus causing a tight mechanical fit with plate fins 13. Bullet 23 is then withdrawn from tube 11 and, if necessary, heat exchanger 10 repositioned so that another tube or tubes may be expanded. If the tubes being expanded are hairpin tubes, then there should be at least two expander rods and bullets driven by yoke 24, as it is desirable to expand both legs of a given hairpin tube at the same time.

Force sensor 40 is comprised and configured so that it produces an electric signal that is proportional to the compressive stress on expander rod 22. Sensor 40, for example, may be of the piezoelectric type.

FIG. 3 shows schematically the electrical components of the present invention. The output of sensor 40 is routed to signal processor 42. A suitable sensor will most likely have an analog output. If processor 42 is a digital device, then the analog output of sensor 40 is converted to a digital signal by analog-to-digital converter 42. Reference numerals 43, 44, 45 and 46 indicate possible outputs from signal processor 42. In a expander embodying the present invention and in which only overload protection is required, the force sensor system would only include overload shutdown 43 and, perhaps, alarm 44. In this embodiment, it would not be necessary to have a very sophisticated signal processor and the processor could be analog, obviating the need for analog-to-digital converter 42. If it is desired to observe the forces or forces on the rod or rods in real time, then the system would include visual display 45. And data file 46 would be required to collect and store data for process analysis. In a system providing the fullest capability, signal processor 42 could be an appropriately configured and programmed personal computer, with visual display 45 then being the monitor of the computer.

We claim:

1. An improved apparatus for radially expanding a tube, said apparatus having an expander rod that drives an expander bullet axially through said tube and that undergoes an axial compressive force during an expansion operation, in which the improvement comprises:

a sensor, having an output signal that is proportional to the force sensed by said sensor, positioned to detect the axial compressive force exerted on said expander rod during an expansion operation.

2. The apparatus of claim 1 in which said output signal is directed via a signal path to a signal processor.

3. The apparatus of claim 2 in which said signal processor actuates an alarm if said output signal exceeds a predetermined value.

4. The apparatus of claim 2 in which said signal processor initiates a shutdown of said apparatus if said output signal exceeds a predetermined value.

5. The apparatus of claim 2 in which said output signal is analog;

said signal processor is digital; and said apparatus further comprises an analog to digital converter in said signal path between said sensor and said signal processor.

6. The apparatus of claim 2 in which said signal processor further comprises means for providing a visual display of said output signal.

7. The apparatus of claim 5 in which said signal processor further comprises means for storing data representative of said output signal.

* * * * *